US005918936A

United States Patent [19]

Murphy

[11] Patent Number: 5,918,936

[45] Date of Patent: Jul. 6, 1999

[54] SEAT LIFT MECHANISM

[76] Inventor: Lloyd F. Murphy, 5641 East Aster Dr., Scottsdale, Ariz. 85254

[21] Appl. No.: 09/023,098

[22] Filed: Feb. 13, 1998

Related U.S. Application Data

[60] Provisional application No. 60/039,741, Feb. 14, 1997.

[51] Int. Cl.[6] ..... A47C 1/00

[52] U.S. Cl. ..... 297/313; 297/DIG. 8; 297/DIG. 10

[58] Field of Search ..... 297/313, DIG. 10, 297/DIG. 8

[56] References Cited

U.S. PATENT DOCUMENTS

| | | | |
|---|---|---|---|
| D. 359,191 | 6/1995 | Whitebread et al. | 297/DIG. 10 X |
| 3,458,872 | 8/1969 | Hellstrom et al. | 4/237 |
| 3,473,174 | 10/1969 | Cool | 4/251 |
| 3,629,880 | 12/1971 | van Rhyn | 297/DIG. 10 X |
| 3,925,833 | 12/1975 | Hunter | 4/251 |
| 3,934,927 | 1/1976 | Zur | 297/DIG. 10 X |
| 4,083,599 | 4/1978 | Gaffney | 297/DIG. 10 X |
| 4,091,473 | 5/1978 | Matthews et al. | 4/420 |
| 4,168,552 | 9/1979 | Austin | 4/237 |
| 4,185,335 | 1/1980 | Alvis | 297/DIG. 10 X |
| 4,249,774 | 2/1981 | Andreasson | 297/DIG. 10 X |
| 4,584,724 | 4/1986 | Wilson | 4/251 |
| 4,629,162 | 12/1986 | Porché | 297/DIG. 10 X |
| 4,688,851 | 8/1987 | Whiteford | 297/313 |
| 4,838,612 | 6/1989 | Cross | 297/313 X |
| 4,852,849 | 8/1989 | Jones | 297/DIG. 10 X |
| 4,862,525 | 9/1989 | Cheng | 4/251 |
| 4,918,771 | 4/1990 | James | 5/81 R |
| 4,929,022 | 5/1990 | Geraci | 297/313 |
| 4,938,533 | 7/1990 | Thielois | 297/DIG. 10 X |
| 4,979,726 | 12/1990 | Geraci | 297/313 |
| 4,985,947 | 1/1991 | Ethridge | 5/81 R |
| 5,052,879 | 10/1991 | Wolfe | 414/541 |
| 5,090,072 | 2/1992 | Gray | 5/81.1 |
| 5,117,516 | 6/1992 | Penner | 5/86.1 |
| 5,309,584 | 5/1994 | Parker | 5/81.1 |
| 5,316,370 | 5/1994 | Newman | 297/313 |
| 5,333,931 | 8/1994 | Weddendorf | 297/DIG. 10 X |
| 5,375,910 | 12/1994 | Murphy | 297/DIG. 10 X |
| 5,411,044 | 5/1995 | Andolfi | 135/66 |
| 5,438,722 | 8/1995 | Jayamanne | 5/618 |
| 5,505,518 | 4/1996 | Pike | 297/DIG. 10 X |
| 5,626,389 | 5/1997 | Logan, Jr. | 297/DIG. 10 X |
| 5,661,858 | 9/1997 | House et al. | 297/DIG. 10 X |
| 5,742,957 | 4/1998 | Vanzant | 297/DIG. 10 X |

*Primary Examiner*—Peter M. Cuomo
*Assistant Examiner*—Rodney B. White
*Attorney, Agent, or Firm*—Quarles & Brady

[57] ABSTRACT

A seat lift employs an integral linkage which causes the seating surface to rise, move forward and tilt as the unit is actuated. The seat motion emulates the natural motion of a person rising from a seated position and is directed by combined linkages of different lengths. A hinged section of the front of the seat surface doubles as an integral linkage and provides a vertical component of motion when the seat is powered. The linkage mechanism is easily adapted to seat lifts of all kinds, such as wheelchairs and public seating in addition to furniture and a portable seat lift. When pneumatically powered, the system employs an easily replaced air chamber which has standardized mounting features and is a cylinder formed of flexible, non-elastic fabric. Separate, easily controlled means are provided to inflate and deflate the air chamber.

2 Claims, 4 Drawing Sheets

SEAT LIFT MECHANISM

CROSS-REFERENCE TO RELATED APPLICATIONS

This application is based on provisional application 60/039,741 filed Feb. 14, 1997 and claims the filing data of this provisional application.

BACKGROUND OF THE INVENTION

This invention relates to improvements for powered seat lifts, including pneumatic seat lifts, and similar devices which are intended for persons who need assistance when sitting down or standing up and relates to the component parts of such assistance devices.

A high percentage of muscular dystrophy, multiple sclerosis, spinal injury and stroke patients may benefit significantly from the independence provided by a seat lift which permits them to regain a standing position, after having been seated, without the assistance of others. A seat lift, when used in nursing homes, hospitals, physical therapy facilities and private homes, can reduce back injuries to healthcare workers or family members who assist a physically impaired person in rising from a seated position.

One method of constructing a seat lift employs a pneumatically operated bellows fitting between, for example, a seat cushion and the structure that would normally support that cushion. A remote source of air serves to inflate the bellows smoothly lifting the person seated on the cushion. An air source, with providing as little as 2 psig, can readily lift a large adult with as little as a square foot of bellows surface area. Such a system is described in U.S. Pat. No. 5,375,910 issued Dec. 27, 1994 by the same inventor as the present application and hereby incorporated by reference.

SUMMARY OF THE INVENTION

The present invention provides an improved seat lift having a simple linkage causing the seating surface to rise, move forward and tilt as the unit is actuated.

Specifically, the invention provides a seat surface sized and shaped to support a seated person and a stationary support positioned beneath the seat surface. An actuator positioned between the seat surface and the stationary support, when actuated, moves the seat surface and stationary support apart. A linkage assembly attached between the seat surface and the stationary support provides increased angulation of the seat surface with respect to the stationary support as the seat surface and stationary support move apart under the influence of the actuator. In the preferred embodiment, the linkage assembly includes a first linkage having a first and second end and pivotally attached at its first end to a front of the seat surface and pivotally attached at its second end to a front portion of the stationary support and a second linkage having a first and second end, the second linkage pivotally attached at its first end to a portion of the seat surface rearward of the front of the seat surface and pivotally attached at its second end to a portion of the stationary support rearward to the front portion of the stationary support wherein the first linkage is shorter than the second linkage. When actuated the seat surface rises, moves forward and tips forward.

Thus it is one object of the invention to provide a motion that follows the natural motion of a person rising from a seated position and is directed by combined linkages of different lengths.

The first linkage may be attached to a front edge of the seat surface to extend therealong and form a substantially continuous surface therewith. The first linkage may be arcuate to provide a downwardly curving front edge for the seating surface when the seating surface is moved apart from the stationary support.

Thus it is another object of the invention to provide a mechanism that presents a continuous surface to the user that the user may easily slide off of without opening that might capture the user's clothing or other articles.

The stationary support may be a plate sized to be received upon the seat of a chair.

Thus it is another object of the invention to provide a seat lift mechanism that is easily adapted to seat lifts of all kinds, such as wheelchairs and public seating in addition to furniture and a portable seat lift.

The foregoing objects and advantages of the invention will appear from the following description. In the description references are made to the accompanying drawings which form a part hereof and in which there is shown by way of illustration a preferred embodiment of the invention. Such embodiment does not necessarily represent the full scope of the invention, however, and reference must be made, therefore to the claims for interpreting the scope of the invention.

DETAILED DESCRIPTION OF THE PREFERRED EMBODIMENT

Figure 1:
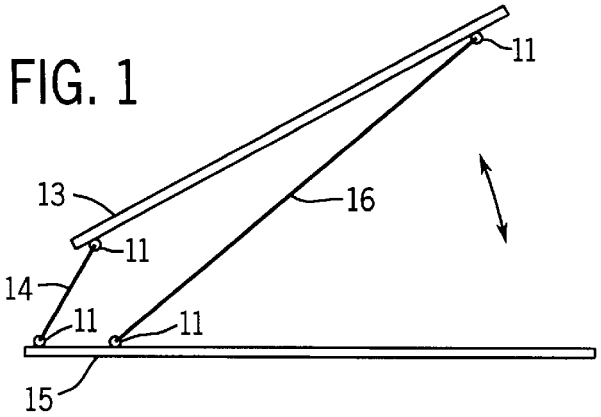
FIG. 1 is a representation of a mechanical linkage system in which it is shown that, when the seat surface 13 is lifted, the short linkage 14 will move in a small arc while the long linkage 16 will simultaneously move in a much larger arc.
Figure 2:
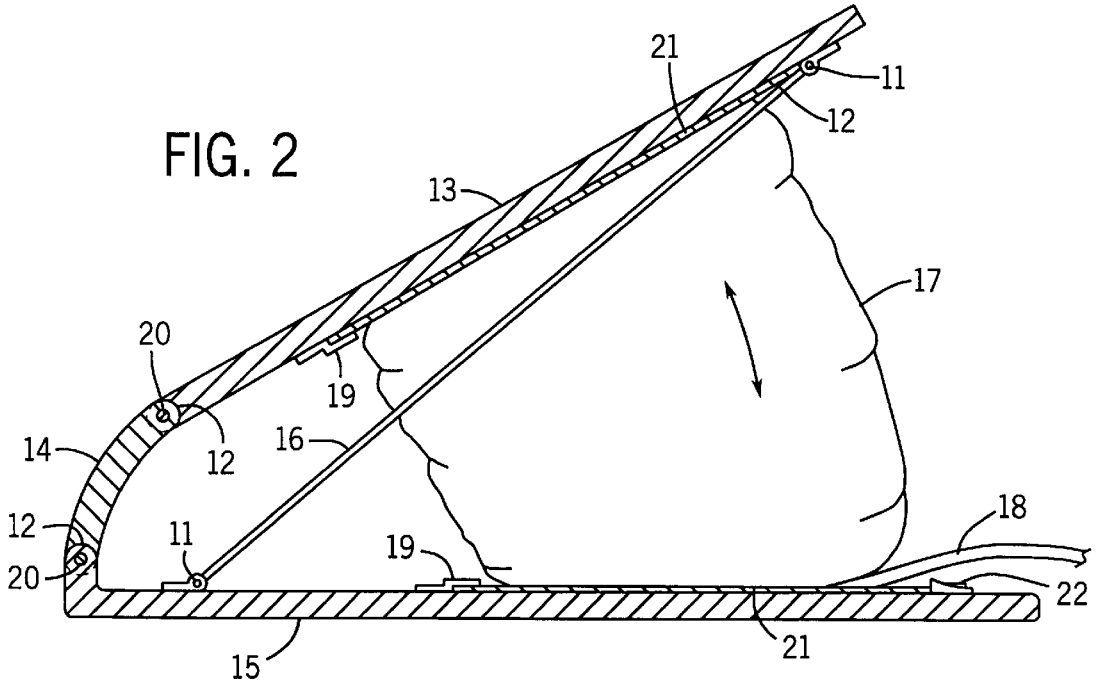
FIG. 2 is a side view of a portable seat lift showing the air chamber 17 partially inflated and showing the relative positions of the seat surface 13 and short linkage 14, of which the short linkage 14 has become a front lip of the seat surface. The stationary support member 15 is shown with the long linkage 16 connected from it to the wide seat surface 13.

Referring to FIG. 1, please note that the short linkage 14 in this figure is functionally the same as the short linkage 14 which is integrated into the seat section as shown in FIG. 2.

Figure 3:
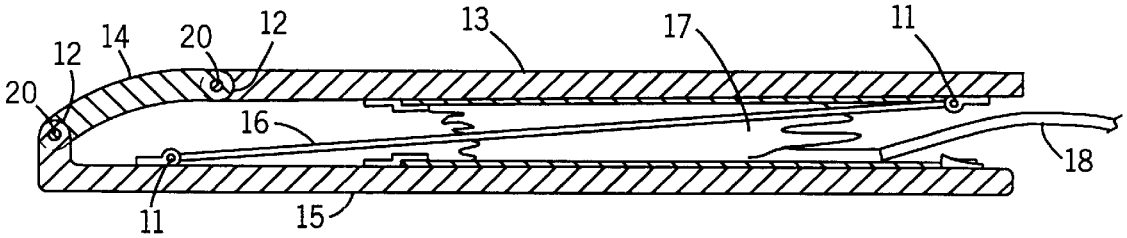
FIG. 3 is similar to FIG. 2 except that the air chamber 17 is shown deflated so that the seat lift is in the fully down position. The relative positions of the linkages 14 and 16 may be noted.
Figure 4:
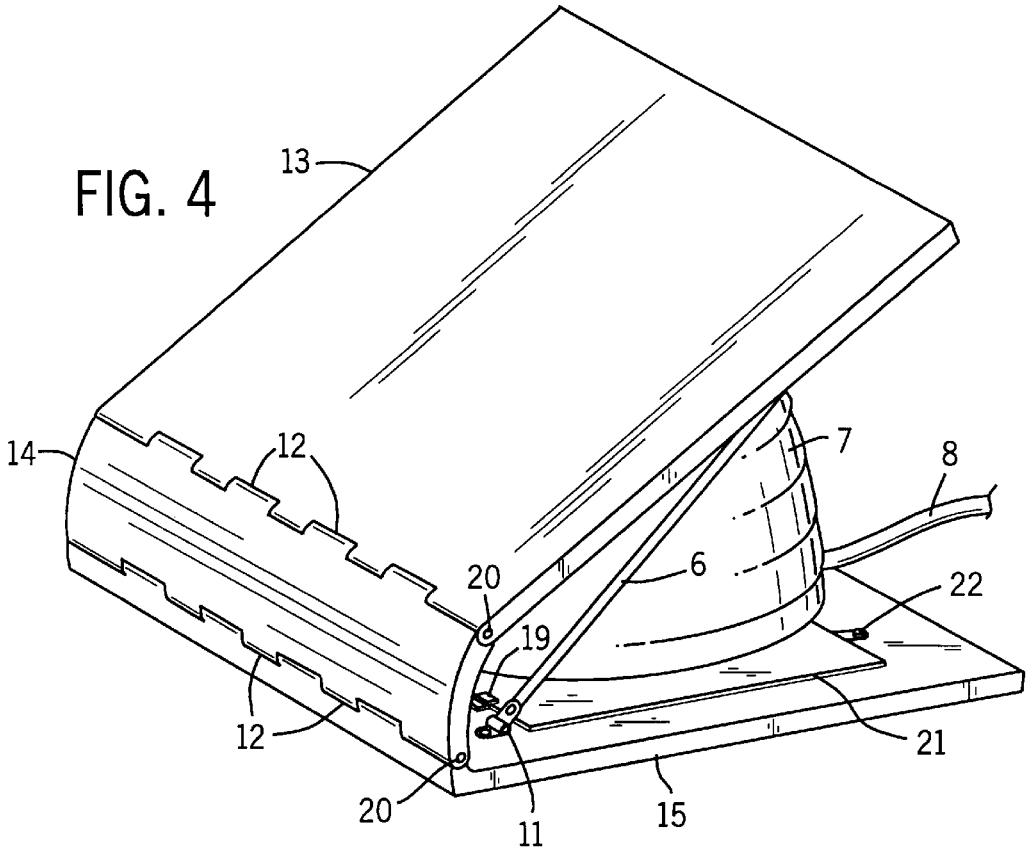
FIG. 4 is an isometric drawing of a portable seat lift with the air chamber 17 partially inflated and shows the hinge knuckles 12 which accept the hinge pins thereby connecting all three sections.

Referring to FIGS. 2 and 3, when the air chamber 17, with standardized end plates 21 held by holders 19 and retaining clips 22 fastened to the stationary support member 15 of a portable seat lift, begins to be inflated through the air inlet tubing 18, the short linkage 14, connected through hinge knuckles 12 by hinge pins 20 to stationary support member 15 and seat surface 13, moves through an arc. If length of the short linkage 14 is, for example, three inches, then the front edge of the seat surface 13 will be lifted three inches and a person sitting on the seat will be raised by this amount. Meanwhile the slope of the seat surface 13 relative to the stationary support member 15 is limited by the long linkage 16 attached by hinges 11. As may be noted from FIG. 2, the slope of the seat surface 13 as shown is about 30 degrees, which is not so steep as to cause a person to slide off, yet the short linkage has already provided almost its full length in vertical travel. It can be seen that if the air chamber 17 continued to be inflated, the seat would be raised and moved forward in an arc guided by the combined actions of the linkages 14 and 16.

It can be seen in FIGS. 12 and 14 that there are open areas which could be used to attach similar linkages 14 and 16 of different lengths should the seat motion require some adjustment. If, for example, a long linkage 16 was replaced by a shorter linkage, the rear of the seat surface 13 would travel through a smaller arc and thus the slope of seat surface 13 would be less. If the short linkage 14 were replaced by a still shorter linkage, then the slope of the seat surface 13 would become steeper more quickly and the seat would not, comparatively, be lifted as high in the front. The integrated short linkage 14, which is also the front section of the seat, may be made narrower or wider to alter its linkage function and, despite this dimensional change, the overall seat size may be maintained by appropriately adjusting the depth dimension of the rear seat surface 13.

Fastening the air chamber's standardized mounting plate to the seat lift may be noted by referring to FIGS. 12, 14 and 19. These figures depict a simple holder 19 with a raised edge under which the end plate 21 may slide. A snap-action retaining clip 22 is shown to keep the end plate 21 in place. The air chamber 17 with its end plate 21 may be removed from the seat lift by removing the retaining clips 22 and sliding the end plate 21 away from the holders 19. Other means to position and retain the air chamber may be developed, however, the objective is to provide a simple means of keeping the air chamber 17 securely positioned on the stationary support member 15 and to provide reliable and simple means of replacing the air chamber if necessary. As the air chambers will all have identical end plates 21, each air chamber is expected to fit into the correct location.

FIGS. 14, 19 and 20 show the hinge pins 20 which extend the full width of the seat. In the case of molded plastic seat sections 13 and 14 and stationary support member 15, it is expected that the hinge suckles 12 will be integrally molded with apertures to receive the hinge pins. The means of molding such features without the need for elaborate tooling accessories is well known. One method is to employ core pins on alternate sides of the mold so each forms a portion of the hole from opposite sides. The tooling for the integral linkage element 14 may be built with mold inserts so that it will produce parts that are wider or narrower than the one shown. The design might alternatively require linkage element 14 be made in two halves which overlap and, when bonded to each other by various processes, form wider or narrower linkage elements.

Figure 8:
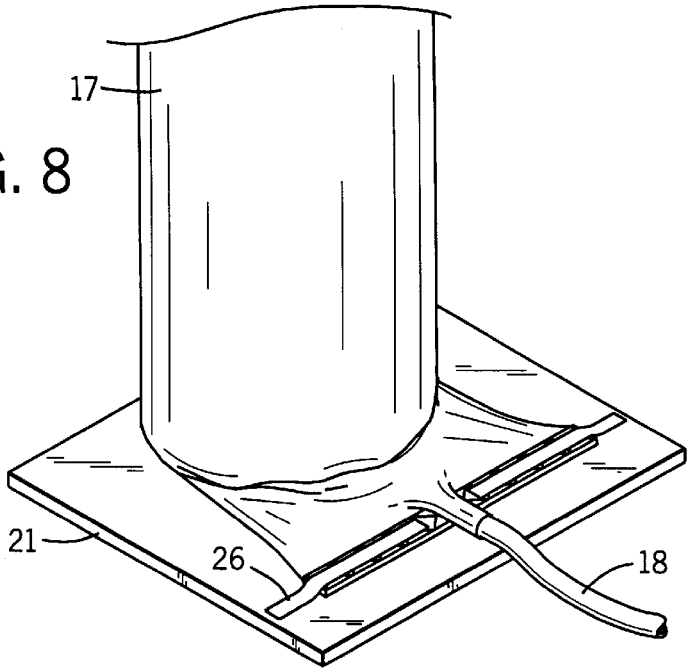
FIG. 8 is a perspective view of the lower portion of the air chamber 17 folded and attached to an end plate 21.
Figure 10:
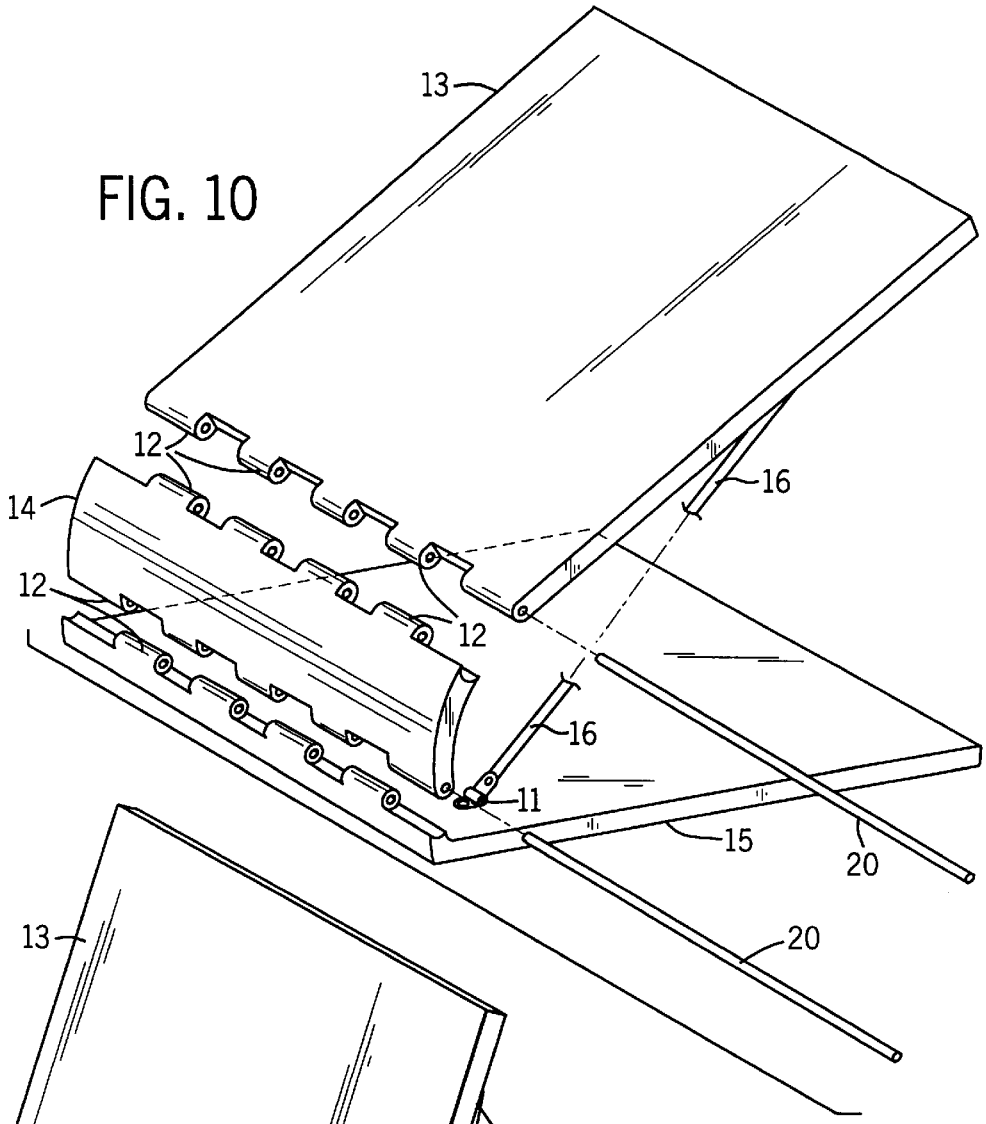
FIG. 10 shows the hinge knuckles 12 of the three main seat components of seat surface 13, short linkage 14 and 15 and the hinge pins 20 prior to assembly.
Figure 9:
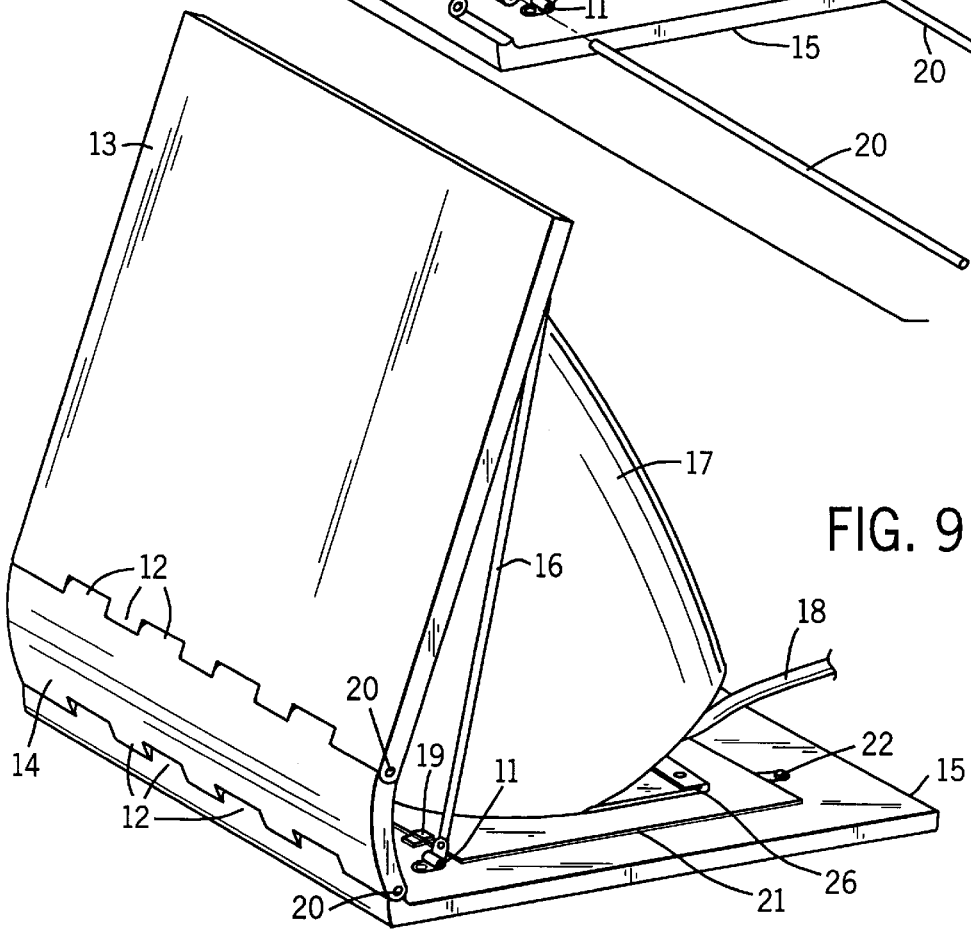
FIG. 9 is an isometric view similar to FIG. 4 except it shows the fabric folds and the end plate 21 more clearly.

FIG. 8 depicts standardized end plates 21 fastened on each end of the completed air chamber 17. The end plates 21 may be molded plastic, wherein many features may be added for convenience of assembly of the air chamber 17 for securing the air inlet tubing 18 and mating with hold-down or locating features on the seat surface 13 and stationary support member 15. These mounting plate features may not require further explanation as similar techniques are used in many industries.

Figure 11:
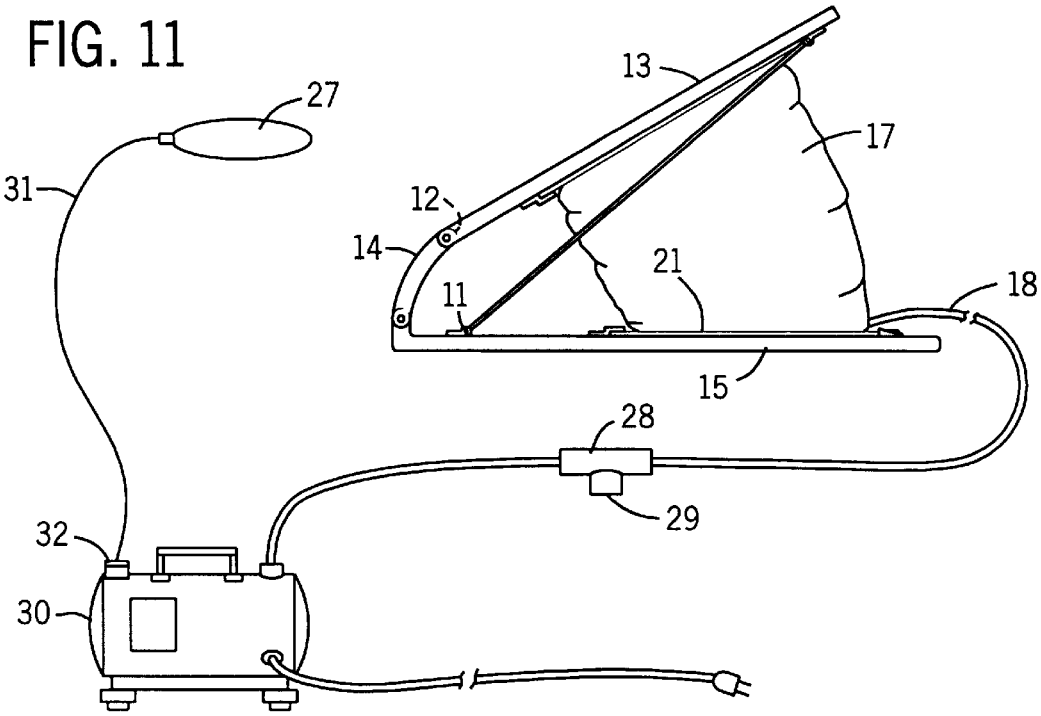
FIG. 11 shows the control system for the pressurized air including the air bulb 27, switch 32 and the passive valve 28.
Figure 5:
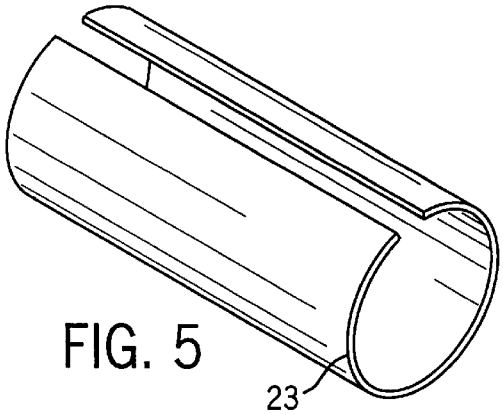
FIG. 5 shows the air chamber fabric 23 ready to seal.
Figure 6:
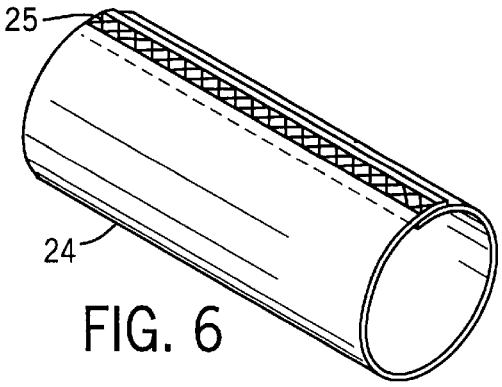
FIG. 6 shows the fabric cylinder 24 sealed along a seam 25.
Figure 7:
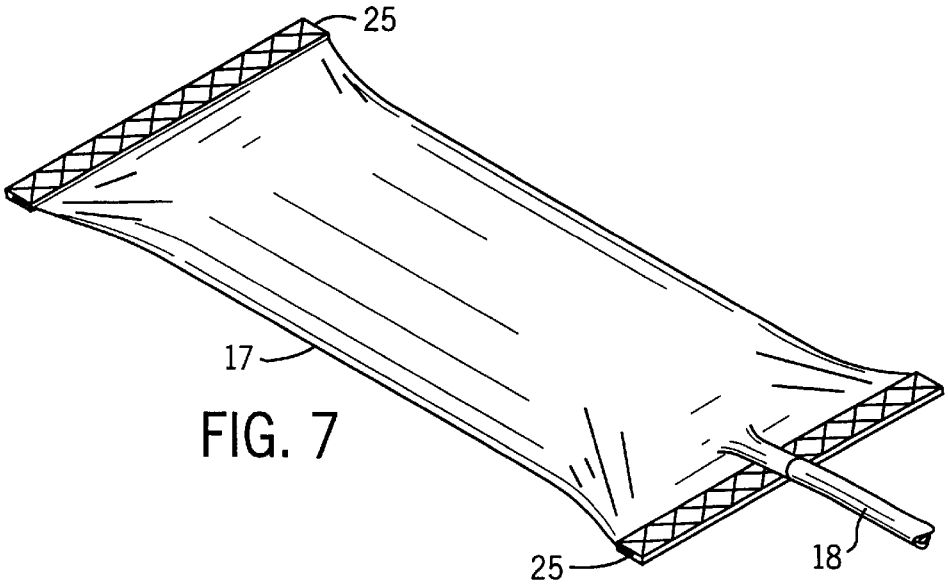
FIG. 7 is a perspective view of the air chamber 17 fully sealed.

FIG. 11 shows the air control system with which the seat lift is controlled by a manual air bulb 27 which, when squeezed, sends a pulse of air through tubing 31 to a diaphragm actuated switch 32 on the compressor 30, thus turning on the compressor which then delivers pressurized air through a passive valve 28 and this air inflates the seat lift's air chamber 17 through air inlet tubing 18. When the operator releases the air bulb 27, the compressor 30 stops and the pressurized air in the air chamber 17 is vented through the passive valve's 28 exhaust port 29. The passive valve 28 retains enough air pressure in the system to hold the seat surface 13 up until a person sits on it, at which time the person's weight compresses the air in the air chamber 17 to a slightly higher pressure than the passive valve 28 setting and additional air exhausts through the port 29 and the person is slowly lowered to a sitting position.

The air chambers 17 are constructed of a lightweight flexible and essentially nonelastic fabric such as rip-stop nylon having a weight of two ounces per square yard. The fabric is treated to have zero porosity with a thin layer of silicone resin, polyurethane resin or the like. Importantly because the fabric is nonelastic (i.e., cannot be stretched in the plane of the fabric) when it is formed into a cylinder and inflated and deflated, there is essentially no change in the circumferential dimension of the air chamber 17 but rather the expansion is solely in the axial direction. In fact provided the loading is properly constrained, as will be described, air chamber 17 deflates under pressure into a single ring, the circular cross-section providing the greatest possible volume necessitated by the entrapped and pressurized air.

Thus, like a bellows system, the expansion of an air chamber under pressurization is almost exclusively along the axial direction, but unlike the bellows system no preformed pleats are required. Ideally either the warp or woof of the fabric used to construct the air chamber 17 should be aligned with the circumferential direction so as to provide fibers that directly resist any circumferential expansion.

The bases of the cylindrical air chamber 17 are not naturally constrained to be planar but instead will tend to bow outward. For this reason, the bases may be bonded to plates placed inside a hermetic fabric envelope of the air chamber 17. However, the plates may also be placed outside the fabric if properly adhered to the fabric and may replace the fabric entirely for the area of the bases. In this application, a cylinder shall be considered to include a frustum of a cylinder or a regular cylinder having parallel bases.

The above description has been that of a preferred embodiment of the present invention. It will occur to those that practice the art that many modifications may be made without departing from the spirit and scope of the invention. In order to apprise the public of the various embodiments that may fall within the scope of the invention, the following claims are made.

I claim:

1. A seat lift comprising:

a seat surface sized and shaped to support a seated person;

a stationary support positioned beneath the seat surface;

an actuator positioned between the seat surface and the stationary support to, when actuated, move the seat surface and stationary support apart;

a linkage assembly attached between the seat surface and the stationary support providing increased angulation of the seat surface with respect to the stationary support as the seat surface and stationary support move apart under the influence of the actuator;

wherein the linkage assembly includes a first linkage having a first and second end, the first linkage pivotally attached at its first end to a front of the seat surface and pivotally attached at its second end to a front portion of the stationary support;

a second linkage having a first and second end, the second linkage pivotally attached at its first end to a portion of the seat surface rearward of the front of the seat surface and pivotally attached at its second end to a portion of the stationary support rearward of the front portion of the stationary support;

wherein the first linkage is shorter than the second linkage;

wherein the actuator is a pneumatic actuator and wherein the pneumatic actuator consists of a flexible cylinder allowing for the introduction of air to inflate the cylinder upon actuation wherein a first base of the flexible cylinder is attached to an underside of the seat surface and a second base of the flexible cylinder is attached to an upper surface of the stationary support.

2. The seat lift of claim 1 wherein the first linkage includes a continuous hinge attaching the front of the seat surface to the front of the stationary support.

* * * * *